US008475561B2

(12) United States Patent
Tateishi et al.

(10) Patent No.: US 8,475,561 B2
(45) **Date of Patent: *Jul. 2, 2013**

(54) METHOD FOR PRODUCING MOLTEN IRON

(75) Inventors: Masataka Tateishi, Kobe (JP); Hiroshi Sugitatsu, Kobe (JP); Hideaki Fujimoto, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 111 days.

This patent is subject to a terminal disclaimer.

(21) Appl. No.: 12/934,453

(22) PCT Filed: Mar. 24, 2009

(86) PCT No.: PCT/JP2009/055852

§ 371 (c)(1),
(2), (4) Date: Sep. 24, 2010

(87) PCT Pub. No.: WO2009/119604

PCT Pub. Date: Oct. 1, 2009

(65) Prior Publication Data

US 2011/0011209 A1 Jan. 20, 2011

(30) Foreign Application Priority Data

Mar. 25, 2008 (JP) ..... 2008-078158

(51) Int. Cl.
*C21C 7/072* (2006.01)
*C21C 7/076* (2006.01)

(52) U.S. Cl.
USPC ..... 75/382; 75/555; 75/584

(58) Field of Classification Search
USPC ..... 75/555, 584, 382
See application file for complete search history.

(56) References Cited

U.S. PATENT DOCUMENTS 3,485,619 A * 12/1969 Maatsch Jurgen et al. ..... 75/385
4,543,125 A 9/1985 Sudo et al.

(Continued)

FOREIGN PATENT DOCUMENTS

JP 63 137114 6/1988
JP 01263211 A * 10/1989

(Continued)

OTHER PUBLICATIONS

Katayama et al. "Metallurgical Reactor". JP 62-023848, published Feb. 16, 1987. English translation of the claim and the brief description of the drawing.*

(Continued)

*Primary Examiner* — George Wyszomierski
*Assistant Examiner* — Tima M McGuthry Banks
(74) *Attorney, Agent, or Firm* — Oblon, Spivak, McClelland, Maier & Neustadt, L.L.P.

(57) ABSTRACT

A method for producing molten iron by melting an iron source material using an iron bath-type melting furnace comprising a top-blowing lance at an upper part of the furnace, a bottom-blowing tuyere in the bottom of the furnace and a tap hole at a lower part on the side of the furnace, the method comprising: a melting process of melting the iron source material, wherein the melting process has at least one tapping process of discharging the molten iron and the slag through the tap hole while holding a position of the furnace in generating the molten iron, and the tapping process continues or interrupts generation of the molten iron and continues top-blowing of the oxygen-containing gas to thereby keep a temperature of the molten iron in the furnace at or above a pre-set lowest temperature of the molten iron.

21 Claims, 3 Drawing Sheets

U.S. PATENT DOCUMENTS

| | | | | |
|---|---|---|---|---|
| 5,078,785 | A * | 1/1992 | Ibaraki et al. | 75/386 |
| 5,246,482 | A * | 9/1993 | Murakami et al. | 75/378 |
| 8,012,237 | B2 * | 9/2011 | Fujimoto et al. | 75/504 |

FOREIGN PATENT DOCUMENTS

| | | |
|---|---|---|
| JP | 3 49964 | 7/1991 |
| JP | 4 246114 | 9/1992 |
| JP | 10 280020 | 10/1998 |
| JP | 10 330813 | 12/1998 |
| JP | 11 52049 | 2/1999 |
| JP | 2001 303114 | 10/2001 |

OTHER PUBLICATIONS

Iwasaki et al. "Melt Reducing Method." JP 01-263211 A, published Oct. 19, 1989. English translation.*

* cited by examiner

METHOD FOR PRODUCING MOLTEN IRON

Cross-Reference to Related Applications

This application is a 371 national stage application of PCT/JP2009/055852 filed Mar. 24, 2009 and claims the benefit of Japanese patent application no. 2008-078158 filed Mar. 25, 2008, the contents of which are incorporated herein by reference.

TECHNICAL FIELD

The present invention relates to a method for producing molten iron (molten pig iron) by melting an iron source material such as solid reduced iron and scrap using an iron bath-type melting furnace.

BACKGROUND ART

In an iron bath-type melting furnace, molten iron is produced by melting an iron source material through combustion of carbon in molten pig iron and/or a carbonaceous material supplied into the furnace with blowing of oxygen. Methods for taking the molten iron stored in the furnace to outside include batch methods and continuous methods. Both methods, however, have still the below-described problems, and there is as yet no established method.

(Conventional Technology 1)

Numerous methods using a converter-type furnace as iron bath-type melting furnace have been proposed (e.g., refer to Patent document 1). However, the method using a converter-type furnace as iron bath-type melting furnace must stop oxygen blowing (i.e., stop production of the molten iron) and tilt the furnace body to discharge molten iron and molten slag (hereinafter may be simply referred to as "slag"). The stop of blowing poses a problem in that the productivity of molten iron is reduced. In addition, the thermal loss from the surface of the furnace body to its outside air in discharging the molten iron decreases the temperature of melt in the furnace, therefore, the method needs a temperature-raising operation to recover the drop of melt's temperature before charging the iron source material until the next blowing starts. This operation poses a problem in that the productivity of molten iron is further reduced.

(Conventional Technology 2)

On the other hand, a continuous molten iron discharge-type melting furnace as iron bath-type melting furnace has been disclosed (refer to Patent document 2). The furnace has: a discharge port of molten iron and slag formed in a side of the furnace bottom; a refractory structure, which is called forehearth, provided at the front face of the discharge port of molten iron and slag; and a channel for continuous discharge of molten iron, which runs from the discharge port of molten iron and slag up to a molten iron discharge position in a molten iron discharge trough, formed inside the refractory structure (i.e., forehearth). However, the thermal loss between the forehearth and the molten iron discharge trough is large in this continuous molten iron discharge-type melting furnace, and the method using this furnace needs heating by an auxiliary burner or the like. Moreover, when oxygen blowing is discontinued on account of equipment malfunction arising from, for instance, the raw material supply equipment or the oxygen supply equipment, the method poses a problem in that molten iron or molten slag solidify and clog between the forehearth and the molten iron discharge trough and that its repair work requires tremendous amounts of time and money. Besides, molten iron is discharged not batch-wise but continuously in this method. As a result, it takes time for a ladle to receive the required amount of molten iron used in a subsequent steel making process, which is a batch process. The drop of temperature of the molten iron discharged initially is herein non-negligible, and, in the worst case, the molten iron may end up solidifying in the ladle.

Patent document 1: Japanese Examined Patent Application Publication No. H3-49964

Patent document 2: Japanese Patent Application Publication No. 2001-303114

DISCLOSURE OF THE INVENTION

In view of the problems described above, an object of the present invention is to provide a method for producing molten iron, using an iron bath-type melting furnace, by melting an iron source material to utilize combustion heat of carbon in molten iron and/or of a carbonaceous material supplied into the furnace elicited by an oxygen-containing gas, such that the method prevents problems such as solidification of molten iron or molten slag on account of drops of temperature in discharging molten iron and slag and that the method improves the productivity of molten iron stably.

In order to solve the above problems, the inventors performed a discharge of molten iron and slag while holding a position of the furnace body during the discharge of molten iron and slag as same as a position of the furnace body during production of molten iron, without tilting the furnace body during discharge of molten iron and slag as in the case of using the converter-type furnace in Conventional technology 1. However, a continuous discharge of molten iron and slag was deemed to be difficult in practice owing to numerous technical issues, as described in Conventional technology 2. Accordingly, the inventors performed an intermittent discharge of molten iron and slag, similar to that in a blast furnace. The inventors assumed that continuous blowing of oxygen-containing gas, also during discharge of molten iron and slag, could be effective for improving the productivity of molten iron while preventing problems such as solidification of molten iron and molten slag on account of drops of temperature during discharge of molten iron and slag. The inventors verified that assumption on the basis of melting experiments using an experimental furnace, and thus accomplished the present invention.

One aspect of the present invention is directed to a method for producing molten iron by melting an iron source material using an iron bath-type melting furnace comprising a top-blowing lance at an upper part of the furnace, a bottom-blowing tuyere in the bottom of the furnace and a tap hole at a lower part on the side of the furnace, the method comprising: a melting process of charging the iron source material, a carbonaceous material and a flux into the furnace and top-blowing an oxygen-containing gas through the top-blowing lance while blowing an inert gas through the bottom-blowing tuyere into melt present in the furnace to stir the melt to thereby melt the iron source material and generate the molten iron and slag using combustion heat of combusting carbon in the carbonaceous material and/or in the molten iron, wherein the melting process has at least one tapping process of discharging the molten iron and the slag through the tap hole while holding a position of the furnace in generating the molten iron, and the tapping process continues or interrupts generation of the molten iron and continues top-blowing of the oxygen-containing gas to thereby keep a temperature of the molten iron in the furnace at or above a pre-set lowest temperature of the molten iron.

An object, feature, aspect and advantage of the present invention will become clearer through reference to the following detailed description and drawings.

BEST MODE FOR CARRYING OUT THE INVENTION

Embodiments of the present invention will be explained in detail below with reference to accompanying drawings. The present invention, however, is in no way limited to or by the embodiments.

[Structure of an Iron Bath-Type Melting Furnace]

Figure 1:
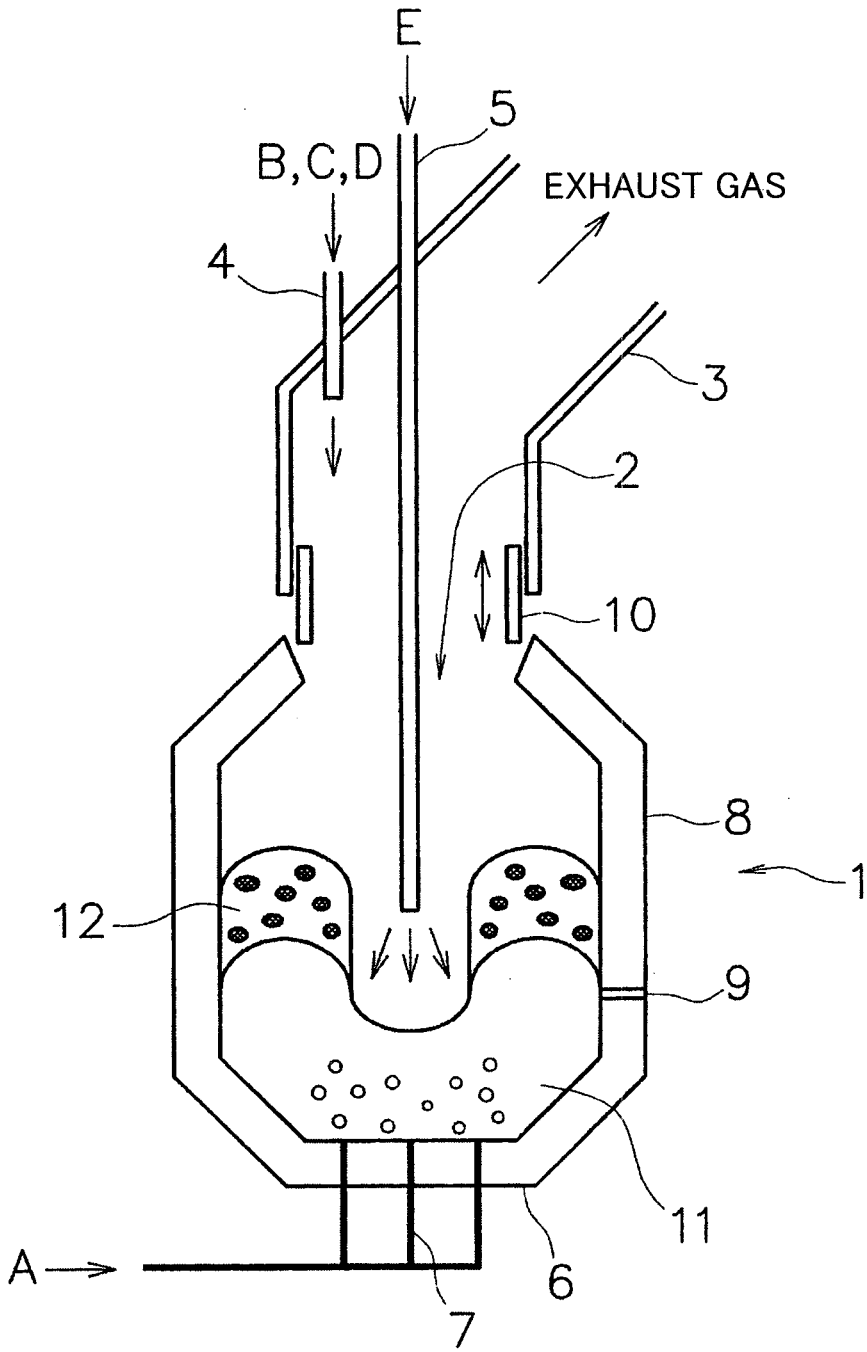
FIG. 1 is a longitudinal sectional view showing a general structure of an iron bath-type melting furnace according to an embodiment.

FIG. 1 shows a general structure of an iron bath-type melting furnace according to an embodiment of the present invention. An iron bath-type melting furnace 1 according to the present embodiment is a vertical reacting furnace. An exhaust gas duct 3 is connected to a furnace throat 2 located at an upper portion of the iron bath-type melting furnace 1. The iron bath-type melting furnace 1 is provided with a raw-material charging chute 4, and a top-blowing lance 5 that is inserted into the furnace through the furnace throat 2 during blowing. In addition, a plurality of bottom-blowing tuyeres 7 are provided in a furnace bottom 6, and a tap hole 9 is provided at a lower part on a furnace side 8. The raw-material charging chute 4 is used to charge an iron source material B, a carbonaceous material C and/or a flux D, as raw materials. The top-blowing lance 5 is used for supplying an oxygen-containing gas E, and the bottom-blowing tuyeres 7 for supplying an inert gas A. The tap hole 9 is used to discharge molten iron (i.e., tapping of molten iron) and to discharge slag (i.e., tapping of slag).

The connection between the exhaust gas duct 3 and the furnace throat 2 of the iron bath-type melting furnace (hereinafter, may be simply referred to as "furnace") 1 is preferably performed in such a way that a skirt 10, provided movably up and down at a lower end portion of the exhaust gas duct 3, covers the top of the furnace throat 2 without coming into close contact therewith. Upon changes in the pressure inside the furnace, therefore, a gap with the furnace throat 2 is adjusted by moving the skirt 10 up and down to discharge thereby part of a furnace gas to the atmosphere or to introduce air into the furnace through the gap. The change in pressure inside the furnace can be suppressed as a result. Slag foaming, which affects fluctuations in pressure inside the furnace, can therefore be prevented more reliably. In the case that the exhaust gas is effectively used as a fuel gas, as described below, the calories of the exhaust gas may drop when air is taken in. However, calorie drop in exhaust gas ceases substantially to be a problem, so that high-calorie exhaust gas can be recovered stably, by performing control in such a manner that the pressure inside the furnace becomes stabilized at once, through intake of air. The amount of air entrained in the exhaust gas is automatically reduced thereby.

In addition, even in the case that the slag overflows from the furnace throat 2 on account of abnormal slag foaming, the slag can be made to spill out only through the gap between the skirt 10 and the furnace throat 2, by relying on a connection in which the skirt 10 is movable up and down. An effect is elicited thereby of avoiding serious equipment damage, such as damage and clogging of an exhaust gas system.

In addition, the exhaust gas duct is preferably provided, for example, with a waste heat boiler (not shown) for recovering sensible heat of the high-temperature exhaust gas. This exhaust gas is preferably used effectively as a fuel gas, after dust removal, since the exhaust gas obtained after the recovery of sensible heat contains a high concentration of carbon monoxide gas (hereinafter may be referred to as "CO gas").

An explanation follows next on a melting process of generating molten iron and slag through melting of the iron source material B, using the iron bath-type melting furnace 1, and then on a tapping process of discharging, out of the furnace, slag and molten iron formed in the melting process.

[Melting Process]

The iron source material B such as solid reduced iron, the carbonaceous material C such as coal and the flux D such as calcined lime and light-burnt dolomite are charged into the iron bath-type melting furnace 1, from the upper side thereof, via a raw material charging chute 4 of, for instance, dropping type relying on gravity, while a molten iron layer 11 is stirred through blowing of the inert gas A such as nitrogen gas via the plurality of bottom-blowing tuyeres 7 into the molten iron layer 11 of the iron bath-type melting furnace 1. The carbon in the molten iron 11 and/or in the carbonaceous material C is caused to combust through top-blowing of an oxygen-containing gas E such as oxygen gas via an injection port provided at the lower end part of the top-blowing lance 5. Solid reduced iron (i.e., the iron source material B) melts on account of the resulting combustion heat, to yield molten iron 11. Slag is also produced at that time.

In addition to nitrogen gas, for example, argon gas (Ar), carbon monoxide gas (CO), carbon dioxide gas ($CO_2$) and the like can be used as the inert gas A. The inert gas A may be used singly, or as a mixed gas in which two or more kinds of gas are combined.

The flow rate of the bottom-blown nitrogen gas (inert gas A) is preferably adjusted so as to range of 0.02 to 0.20 $Nm^3$/min per ton of molten iron layer in order to ensure the melting rate of the solid reduced iron (i.e., the iron source material B) by sufficiently stirring the molten iron layer 11.

In addition to solid reduced iron, for example, scrap, mill scale and the like can be used as the iron source material B. The iron source material B may be used singly or in combinations of two or more types.

As to the solid reduced iron, for example, solid reduced iron obtained by thermally reducing carbon composite iron oxide agglomerates in a moving-bed type thermal reduction furnace such as rotary hearth furnace, linear furnace, rotary kiln and the like can be used. The carbon composite iron oxide agglomerates are obtained by agglomerating a powder mixture composed of an iron oxide source such as iron ore, steel plant dust and the like and a carbonaceous reductant such as coal. Conventional natural-gas solid reduced iron can also be used as the solid reduced iron. These solid reduced irons may be charged directly into the iron bath-type melting furnace 1 while hot, in the form of high-temperature solid reduced iron immediately after reduction, with substantially no cooling. Alternatively, the solid reduced iron may be charged into the iron bath-type melting furnace 1 after having being cooled to ordinary temperature. In terms of decreasing the carbonaceous material consumption of the iron bath-type melting furnace 1, there is preferably used a solid reduced iron having a metallization ratio of 60% or higher, preferably 80% or higher, and yet more preferably 90% or higher, similar to the melting heat quantity of scrap.

In addition to coal, for example, coke, oil coke, charcoal, woodchip, plastic waste, used tire, and a bedding carbonaceous material (including charred material) used in the rotary hearth furnace can be charged as the carbonaceous material C. These materials may be used alone or in combination.

Figure 2:
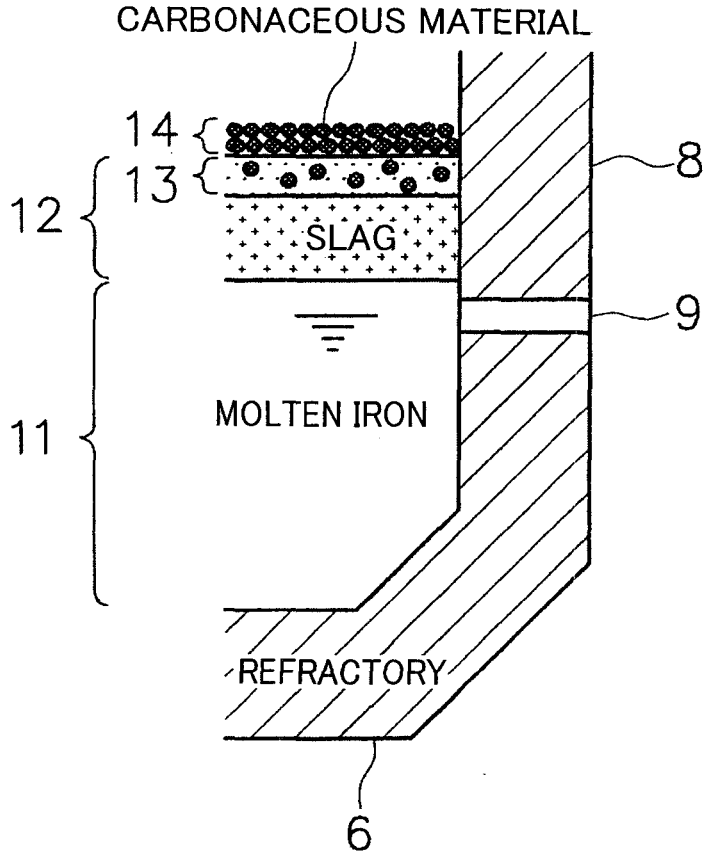
FIG. 2 is a longitudinal sectional view schematically showing the distribution of a carbonaceous material around a slag layer contained in the iron bath-type melting furnace.

The charging period and charge amount of the carbonaceous material C are preferably adjusted in terms of preventing abnormal slag foaming in the furnace, and allowing slag to be discharged reliably without tilting the melting furnace but keeping the latter in the same position as during the generation of the molten iron. As shown in a schematic view of FIG. 2, there is preferably formed a carbonaceous material suspending slag layer 13, in which part of the carbonaceous material C is suspended, on the top layer portion of a molten slag layer 12 that is formed on the molten iron layer 11, while a carbonaceous material covering layer 14, comprising only the carbonaceous material C, is further formed on the carbonaceous material suspending slag layer 13.

By forming the carbonaceous material suspending slag layer 13 in the upper portion of the slag layer 12, the (FeO) concentration of slag contained in the carbonaceous material suspending slag layer 13 is decreased and the generation rate of CO gas bubbles, which give rise to foaming, is decreased. Furthermore, the CO air bubbles are easily released from the slag layer 12 because of a carbonaceous material contained in the slag. Consequently, forming becomes not easily caused.

In addition, by forming the carbonaceous material coating layer 14 on the carbonaceous material suspending slag layer 13, the temperature of the slag layer 12 is kept by the carbonaceous material coating layer 14. Therefore, slag can be prevented from being cooled and solidified in the tap hole 9 during tapping of slag. Thus, a smooth and quick slag discharge operation can be carried out, without overflow of the carbonaceous material C in the carbonaceous material covering layer 14 that is formed on top of the carbonaceous material suspending slag layer 13, and without tilting of the furnace body, which is kept in the same position as during the formation of the molten iron. This is compounded with the molten iron temperature holding effect in the below-described tapping process.

In order to bring out more reliably the effect elicited by forming the carbonaceous material suspending slag layer 13 and the carbonaceous material covering layer 14, the carbonaceous material C is preferably charged into the iron bath-type melting furnace 1 having molten iron stored therein, as a hot metal, prior to charging of the iron source material B and the flux D before start of the top-blowing of the oxygen-containing gas E. The reason for this is that the carbonaceous material suspending slag layer 13 is formed more reliably since the carbonaceous material C present on the molten iron layer 11 becomes suspended at once at the top layer of the molten slag layer 12, from the initial melting stage of the solid reduced iron B. The carbonaceous material C can be charged after discontinuing the charging, or decreasing the charge amount, of the iron source material B and the flux D, in order to effectively replenish the carbonaceous material of the carbonaceous material suspending slag layer 13 and the carbonaceous material covering layer 14, also during continuous top-blowing of the oxygen-containing gas E.

In order to bring out more reliably the effect elicited by forming the carbonaceous material suspending slag layer 13 and the carbonaceous material covering layer 14, at the start of the discharge of molten iron (i.e., tapping of molten iron), the total amount of the carbonaceous material in the carbonaceous material suspending slag layer 13 and in the carbonaceous material covering layer 14 (that is, the amount of the carbonaceous material remaining in the furnace) is preferably set to range from 100 to 1,000 kg per 1,000 kg of slag in the molten slag layer 12. That is because the above-described effect of preventing foaming and the effect of facilitating a smooth and quick slag discharge operation are enhanced when the above total amount of the carbonaceous material is not smaller than 100 kg, since in that case there increases the amount of carbonaceous material in the carbonaceous material suspending slag layer 13 and the carbonaceous material covering layer 14 becomes thicker. Meanwhile, if the above total amount of the carbonaceous material is no greater than 1,000 kg, the slag layer 12 is sufficiently stirred through curbing of the slag uptake by the carbonaceous material of the carbonaceous material covering layer 14 and through curbing of the integration of the carbonaceous material (the carbonaceous material covering layer 14) caused by heating, so that, as a result, there is no drop in the melting rate of the solid reduced iron B into the molten iron layer 11. The total amount of the carbonaceous material per 1,000 kg of slag in the molten slag layer 12 ranges more preferably from 150 to 500 kg and yet more preferably from 200 to 300 kg.

Herein, the amount of the carbonaceous material remaining in the furnace can be calculated, for example, by subtracting the sum total of the amount of carbonaceous material used for reducing unreduced iron oxide in the solid reduced iron, the amount of carbonaceous material used for carburizing the produced molten iron, the amount of carbonaceous material combusted by the top-blown oxygen gas, and the amount of carbonaceous material scattered as dust in the exhaust gas, from the amount of the carbonaceous material charged into the furnace. The slag amount in the molten slag layer 12 can be calculated, for instance, by subtracting the discharged slag amount from the amount of slag produced and which is calculated from the amount of gangue in the solid reduced iron, the amount of ash in the carbonaceous material, and the amount of flux, that are charged into the furnace.

The average grain size of the carbonaceous material C charged into the iron bath-type melting furnace 1 ranges preferably from 2 to 20 mm. Scattering into the exhaust gas can be readily suppressed when the average grain size is not smaller than 2 mm. When the average grain size is no greater than 20 mm, the (FeO) concentration in the slag layer 12 drops sufficiently, and there increases the carburization rate into the molten iron layer 11. In terms of further suppressing scattering into the exhaust gas, the average grain size is more preferably not smaller than 3 mm. In terms of further lowering the iron oxide concentration in the slag layer 12 and further raising the carburization rate in the molten iron layer 11, the average grain size is more preferably no greater than 15 mm.

In order to ensure the fluidity of the slag layer 12 and to facilitate desulfurization from the molten iron, the basicity $CaO/SiO_2$ (mass ratio) of the slag layer 12 is preferably adjusted so as to range from 0.8 to 2.0, more preferably from 1.0 to 1.6.

In addition to oxygen gas, for example, oxygen-enriched air can be used as the oxygen-containing gas E. The oxygen-containing gas E can be a gas that contains enough oxygen to enable combustion of carbon in the carbonaceous material C and/or in the molten iron layer 11, and to melt the iron source material on account of the resulting combustion heat.

The flow rate of oxygen gas (i.e., the oxygen-containing gas E) that is supplied from the top-blowing lance 5 is preferably adjusted in such a manner that molten iron and slag are produced through combustion of the carbon in the carbonaceous material C and/or in the molten iron layer 11 and through sufficient melting of the solid reduced iron (i.e., the iron source material B) on account of the resulting combustion heat.

The secondary combustion ratio represented by $CO_2/(CO+CO_2)$ in a simplified calculation formula can be controlled to an recommended value (no greater than 40%, more preferably ranging from 10 to 35%, and yet more preferably ranging from 15 to 30%), by adjusting the flow rate of the top-blowing oxygen gas and/or the height of the top-blowing lance 5. The consumption amount of carbonaceous material can be reduced as a result without placing an excessive thermal load on the refractory of the iron bath-type melting furnace 1.

The slag layer 12 undergoes a stirring effect through blowing the oxygen gas (i.e., the oxygen-containing gas E) from the top. This is compounded with the stirring effect of the molten iron layer 11 elicited by the bottom-blown nitrogen gas (i.e., the inert gas A), as a result of which there are promoted both melting of the solid reduced iron B in the molten iron layer 11 and carburization in the molten iron layer 11 by the carbonaceous material C at the interface between the molten iron layer 11 and the slag layer 12. In the method for producing molten iron in which there are formed the carbonaceous material suspending slag layer 13 and the carbonaceous material covering layer 14, carburization is promoted by the presence of the carbonaceous material suspending slag layer 13, and decarburization of the molten iron by oxygen blowing does not take precedence over molten iron carburization. Therefore, it becomes possible to produce molten iron having a high carbon concentration, as compared with a molten iron production method in which the carbonaceous material suspending slag layer 13 and the carbonaceous material covering layer 14 are not formed.

In the method for producing molten iron in which there are formed the carbonaceous material suspending slag layer 13 and the carbonaceous material covering layer 14, the carbon content in the molten iron is preferably not smaller than 3 mass %, and ranges more preferably from 3.5 to 4.5 mass %. Accordingly, the iron content in the slag layer 12 is preferably lowered to about 10 mass % or less, more preferably about 5 mass % or less, and yet more preferably about 3 mass % or less, since lowering the iron content in the slag layer 12 has the effect of promoting desulfurization from the molten iron layer 11 and of suppressing damage to the furnace-lining refractory caused by molten FeO.

[Tapping Process]

The above-described melting operation is continued for a predetermined time, to store a predetermined amount (for instance, one tapping's worth) of molten iron and slag in the iron bath-type melting furnace 1. Thereafter, molten iron and slag are tapped (i.e., an intermittent tapping of molten iron and slag is carried out). Specifically, in an operation similar to tapping of molten iron and slag in a blast furnace, a tap hole 9 is drilled, without tilting the body of the iron bath-type melting furnace 1 but preserving the position of the furnace at the time at which molten iron is generated (for instance, upright). Thereupon, molten iron is discharged first, until the bath surface thereof reaches the level of the tap hole 9. After that, slag is discharged.

Herein, top-blowing oxygen gas (i.e., the oxygen-containing gas E) goes on being supplied during discharge of molten iron and slag, so that the molten iron temperature in the furnace is kept at or above a pre-set lowest molten iron temperature. Although the flow rate of the top-blowing oxygen gas (i.e., the oxygen-containing gas E) varies depending on, for instance, the composition and temperature of the molten iron, and on the amount of stored molten iron, the flow rate may be adjusted in such a manner that the molten iron temperature in the furnace is kept at or above the set temperature. For instance, the flow rate can be set to the same flow rate as before discharging molten iron and slag. The flow rate may be reduced in accordance with the amount of stored molten iron that remains in the furnace as the discharge of molten iron and slag progresses. Alternatively, the flow rate may be increased in accordance with the drop of temperature of the molten iron remaining in the furnace.

Drops of the temperature of the melt in the furnace during discharge of molten iron and slag can be suppressed thanks to the combustion heat of combusting carbon in the coal (i.e., the carbonaceous material C) and/or in the molten iron, through continuous supply of top-blowing oxygen gas (i.e., the oxygen-containing gas E).

From the viewpoint of the drop of temperature on account of, for instance, discharge of molten iron and slag and conveyance of molten iron within the steelmaking facilities, the lowest molten iron temperature is preferably set to, for instance, 1450° C., more preferably 1480° C., and yet more preferably to 1500° C.

In addition to the continuous supplying of top-blowing oxygen gas (i.e., the oxygen-containing gas E), charging of coal (i.e., the carbonaceous material C) is preferably continued also during discharge of molten iron and slag.

The carbon concentration in the molten iron and the amount of carbonaceous material suspended in the slag layer 12 can be preserved through a continuous charging of coal (i.e., the carbonaceous material C). This allows suppressing temperature drops in the slag layer during discharge of molten iron and slag, preventing thereby more reliably clogging of the tap hole 9 caused by slag solidification, and facilitates the formation of the carbonaceous material suspending slag layer 13 and the carbonaceous material covering layer 14 during melting of the solid reduced iron (i.e., the iron source material B) after discharging molten iron and slag.

In addition to continuing the supply of top-blowing oxygen gas (i.e., the oxygen-containing gas E) and the charging of coal (i.e., the carbonaceous material C), charging of solid reduced iron (i.e., the iron source material B) is also preferably continued during discharge of molten iron and slag.

Molten iron can be produced also during discharge of molten iron and slag through a continuous charging of the solid reduced iron (i.e., the iron source material B). Specifically, production of molten iron sometimes stops when no solid reduced iron (i.e., the iron source material B) is charged during discharge of molten iron and slag. However, continuing the charging of the solid reduced iron (i.e., the iron source material B) as before discharging molten iron and slag allows continuing the generation of molten iron also during discharge of molten iron and slag. The productivity of molten iron can be further enhanced thereby.

In addition to continuing the supply of top-blowing oxygen gas (i.e., the oxygen-containing gas E) and the charging of coal (i.e., the carbonaceous material C), charging of flux D is also preferably continued during discharge of molten iron and slag. In addition to continuing the supply of top-blowing oxygen gas (i.e., the oxygen-containing gas E), charging of coal (i.e., the carbonaceous material C) and charging of solid reduced iron (i.e., the iron source material B), also charging of flux D from the melting process is preferably further continued during the discharge of molten iron and slag.

The composition of the molten slag can be maintained through a continuous charging of the flux D. Slag fluidity can be secured, melting damage to the refractory can be suppressed, and slag foaming can be prevented yet more reliably as a result.

In the case that charging of the solid reduced iron (i.e., the iron source material B) is continued also during discharge of molten iron and slag, molten iron and slag can be discharged while keeping the charging rate of solid reduced iron during discharge of molten iron and slag at the charging rate of solid reduced iron prior to discharge of molten iron and slag, through setting of the above-described lowest molten iron temperature to, for instance, 1450° C. or above. In the case of a lower lowest molten iron temperature, or if the amount of stored molten iron is small, however, the charging rate of the solid reduced iron (i.e., the iron source material B) during discharge of molten iron and slag is preferably smaller than the charging rate of the solid reduced iron (i.e., the iron source material B) before discharging molten iron and slag.

The amount of the melt held in the furnace decreases abruptly during discharge of molten iron and slag, and hence, in the case that the charging rate of the solid reduced iron (i.e., the iron source material B) during discharge of molten iron and slag is kept the same as that before discharging molten iron and slag, then reduced iron (i.e., the iron source material B) having a significantly lower temperature than melt is charged, in a substantial amount, onto the melt having a lowered heat capacity. As a result, the temperature of the melt tends to drop abruptly (Meanwhile, supply of top-blowing oxygen gas and charging of coal are both continued during discharge of molten iron and slag, and hence the resulting combustion heat might conceivably allow the temperature of the melt to be recovered to the original temperature. However, the heat transfer rate from gas to a molten material is smaller than the heat transfer from a solid to a molten material. Recovery of the temperature of the melt is thus found to take some time). Preferably, therefore, a drop of temperature of the molten iron layer is prevented by lowering the charging rate of solid reduced iron (i.e., the iron source material B) during discharge of molten iron and slag to be lower than the charging rate of the solid reduced iron (i.e., the iron source material B) at a time when no discharge of molten iron and slag is being carried out. The extent of the lowering in the charging rate of the solid reduced iron (i.e., the iron source material B) during discharge of molten iron and slag may be appropriately adjusted in accordance with, for instance, the melt holding amount of the iron bath-type melting furnace 1 and in accordance with the discharge of molten iron and slag rate. For instance, the charging rate may be set to be no greater than 75% of the charging rate of the solid reduced iron (i.e., the iron source material B) at a time when no discharge of molten iron and slag is being carried out (see Examples 1 and 2 described below).

The inert gas A is blown in via the bottom-blowing tuyeres 7.

In the tapping process, preferably, the height position (i.e., lance height) of the lower end of the top-blowing lance 5 is controlled in such a manner so as to follow the change in the height position of the melt surface in the iron bath-type melting furnace 1. The lance height may be changed continuously, or step-wise.

Specifically, the height position of the melt surface drops on account of discharge of molten iron and slag. Accordingly, if the height position (i.e., lance height) of the lower end of the top-blowing lance 5 is fixed, there grows the distance between the lower end of the top-blowing lance 5 and the level of the melt surface, and there change the oxygen blowing condition and the combustion condition in the furnace. This gives rise to changes in the amount of combustion heat that is generated and in the amount of heat transferred to the melt, and fluctuations in the temperature of the melt. Preferably, therefore, the height position (i.e., lance height) of the lower end of the top-blowing lance 5 is lowered so as to follow changes in the height position of the melt surface, so that a constant distance is kept between the lower end of the top-blowing lance 5 and the melt surface, to prevent thereby, as much as possible, changes in the oxygen blowing condition and/or the combustion condition. In the case that molten iron is produced through charging of iron source material in the tapping process, the height position of the lower end of the top-blowing lance 5 may be raised or lowered so as to follow rises and drops of the height position of the melt surface.

Changes in the height position of the melt surface during the discharge of molten iron and slag can be predicted on the basis of, for instance, a relationship between an amount of discharged molten iron and slag and a time elapsed from a time point of starting discharge of molten iron and slag, as measured in a past tapping process.

Figure 3:
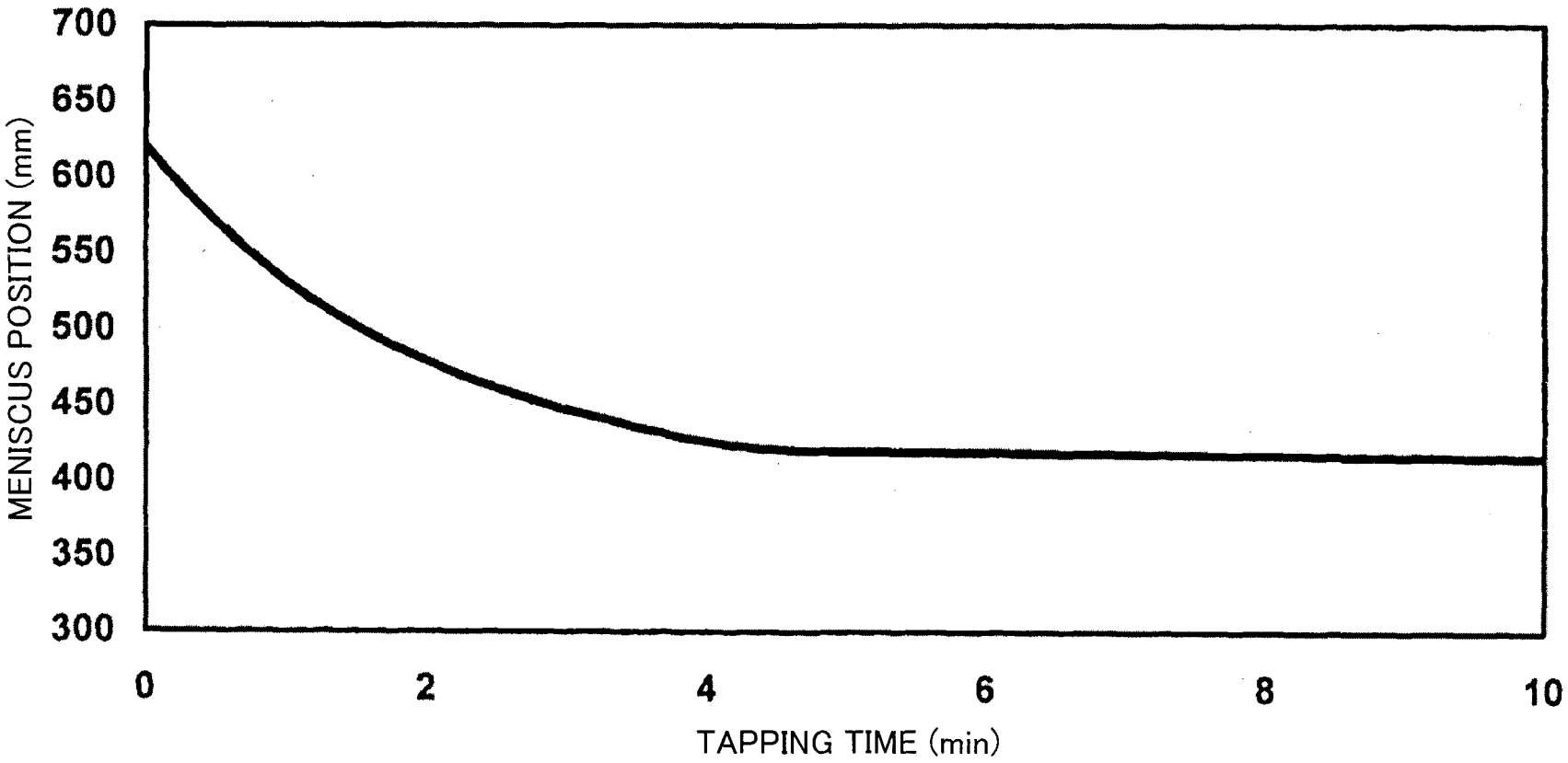
FIG. 3 is a graph showing the change in the height position of the surface of a molten iron melt in a furnace with time, during discharge of molten iron and slag.

FIG. 3 is a graph showing the change in the height position of the surface of a molten iron melt in a furnace with time in a tapping process. Specifically, FIG. 3 is a graph arrived at by measuring, over time, the melt discharge amount (volume) from the start of melt discharge in a tapping process in the method for producing molten iron of the present invention using the experimental furnace of the below-described examples, by calculating the change in the height position of the surface of the melt with time from the relationship between the measured melt discharge amount and the required time from the start of the melt discharge and from the internal shape of the experimental furnace, and by plotting then the meniscus position in the furnace in the vertical axis, and the tapping time in the horizontal axis. The height position (i.e., lance height) of the lower end of the top-blowing lance 5 can be controlled on the basis of the above graph.

The melt discharge amount may also be measured through gravimetric measurement using a load cell, instead of by volumetric measurement of the melt discharge amount.

Alternatively, the height position (i.e., meniscus position) of the melt surface during discharge of molten iron and slag may be measured directly using a level meter such as a microwave level meter. The height position of the lower end of the top-blowing lance is controlled on the basis of the measurement results.

Alternatively, the height position (i.e., lance height) of the lower end of the top-blowing lance may be controlled on the basis of the composition of the exhaust gas from the iron bath-type melting furnace during discharge of molten iron and slag.

When the distance between the lower end of the top-blowing lance 5 and the melt surface changes, there varies also the blowing condition and the combustion condition in the furnace, and there changes the exhaust gas composition, for instance in terms of the concentration of CO and $CO_2$. Therefore, the lance height is controlled for instance in such a manner that the CO concentration and/or $CO_2$ concentration in the exhaust gas falls within a predetermined range (for instance, in such a manner that the CO concentration ranges from 20 to 25%), to allow thereby the blowing condition and combustion condition in the furnace to vary as little as possible. The lance height may also be controlled on the basis of the secondary combustion ratio, instead of on the basis of the CO concentration and/or $CO_2$ concentration.

As described above, the molten iron temperature in the furnace is kept high, also during discharge of molten iron and slag. Moreover, molten iron having a large heat capacity is discharged first. Therefore, the tap hole 9 is kept sufficiently warm, so that slag does not cool readily even when slag is discharged subsequently. This allows effectively preventing the tap hole 9 from becoming clogged on account of slag solidification.

Discharge of slag is terminated when carbonaceous material starts being discharged, mixed with the slag, from the tap hole 9, i.e., when the carbonaceous material suspending slag layer 13 starts being discharged. The tap hole 9 may then be closed with mud.

In order to prevent the gas in the furnace from jetting out of the tap hole 9, the pressure in the furnace is preferably set to normal pressure (for instance, a gauge pressure from −1 kPa to +1 kPa, preferably from −500 Pa to +500 Pa, and more preferably from −100 Pa to +100 Pa).

As described above, the discharge of molten iron and slag operation can be carried out quickly and smoothly, without tilting the furnace but keeping the latter upright, and while preventing slag foaming, by repeating the melting process and the tapping process, i.e. by carrying out melting and intermittent discharge of molten iron and slag. Thereby, blowing can be continued also during discharge of molten iron and slag, and the productivity of molten iron can be increased stably through melting of various raw materials.

To end the production of molten iron, a predetermined amount of molten iron/slag is stored in the melting process. Thereupon, top-blowing of the oxygen-containing gas is discontinued, and from the tap hole 9, the molten iron is discharged together with the slag (i.e., tapping of molten iron and slag).

(Modification)

In the above embodiment there is used an iron bath-type melting furnace 1 having a non-sealed structure, but the embodiment is not limited thereto, and there may be used an iron bath-type melting furnace 1 having a sealed structure.

In the above embodiment, an example is explained wherein there is provided just one tap hole 9. However, it is preferable to provide a plurality of tap holes in the furnace height direction, since the level of the bottom face of the furnace drops in proportion to the melting damage of the furnace refractory. The tap holes 9 may be provided at a plurality of positions in a horizontal circumferential direction of the furnace, for instance in a 180° direction, in 90° directions, or 120° directions. The tap hole 9 has been explained only in an example where the tap hole 9 is used for discharge of both molten iron and molten slag, although there may be provided a dedicated tap hole for molten slag if the amount of molten slag produced is substantial.

In the above embodiment, an example has been explained wherein discharge of molten iron and slag is carried out when the total amount of molten iron and slag stored in the iron bath-type melting furnace 1 (i.e., amount of stored molten iron and stored slag) reaches a predetermined amount. However, discharge of molten iron and slag may also be carried out when the molten iron stored in the iron bath-type melting furnace 1 (i.e., amount of stored molten iron) reaches a predetermined amount, or when the amount of slag stored in the iron bath-type melting furnace 1 (i.e., amount of stored slag) reaches a predetermined amount.

In the above embodiment, an example has been explained wherein the carbonaceous material C and the flux D are charged into the furnace by gravity dropping, but the carbonaceous material C and the flux D may be finely crushed and directly blown onto the slag layer. However, charging by gravity dropping is preferable, from the viewpoint of keeping equipment and operational costs down.

Although the above embodiment an example is explained wherein there is provided only one top-blowing lance 5, the latter may be provided as a plurality of thereof, depending on the scale and shape of the furnace.

In the above embodiment, an example is explained wherein the top face of the molten iron layer 11 is taken as the melt surface. However, the top face of the molten slag layer 12 may also be used, instead of the top face of the molten iron layer 11.

EXAMPLES

The present invention will be explained in more detail by way of examples. The present invention, however, is in no way limited to or by the examples.

In order to verify the effect of the present invention, a melting test was performed on solid reduced iron, using a vertical reacting furnace having a refractory inner diameter of 2 m and an in-furnace effective height of 2.6 m, the furnace being provided with a bottom-blowing tuyere at the furnace bottom, a top-blowing lance at the furnace top, and a tap hole in the furnace side, at a position standing at a height of 0.4 m from the furnace bottom.

As the iron source material there was used solid reduced iron having a component composition as given in Table 1 and obtained through heating reduction of composite pellets of iron oxide-carbonaceous material formed using steel plant dust as an iron-oxide raw material, in a rotary hearth furnace, followed by cooling to normal temperature. In the grain size row of Table 1, "+3.35 mm, 64%" denotes that the mass ratio of reduced iron remaining on a sieve upon sifting using an 3.35 mm-mesh sieve was 64% of the total reduced iron; "+6.7 mm, 75%" denotes that the mass ratio of reduced iron remaining on a sieve upon sifting using an 6.7 mm-mesh sieve was 75% of the total reduced iron; "+6.7 mm, 93%" denotes that the mass ratio of reduced iron remaining on a sieve upon sifting using an 6.7 mm-mesh sieve was 93% of the total reduced iron. As the carbonaceous material there was used a coke breeze having the component composition of Table 2. In the grain size row of Table 2, "+12 mm" denotes the coke breeze of Table 2 that remained on a 12 mm-mesh sieve upon sifting of the coke breeze. Calcined lime and dolomite were used as the flux. Nitrogen gas was used as the inert gas supplied through the bottom-blowing tuyeres, and oxygen gas was used as the oxygen-containing gas supplied through the top-blowing lance.

TABLE 1

| | | Item | | |
|---|---|---|---|---|
| | | Solid reduced iron (1) | Solid reduced iron (2) | Solid reduced iron (3) |
| | | Grain size | | |
| Component | Unit | +3.35 mm 64% | +6.7 mm 75% | +6.7 mm 93% |
| T•Fe | mass % | 58.1 | 75.6 | 81.1 |
| FeO | mass % | 13.2 | 8.0 | 16.8 |
| Gangue | mass % | 23.8 | 6.8 | 7.1 |
| C | mass % | 7.2 | 10.5 | 4.2 |
| S | mass % | 0.6 | 0.13 | 0.08 |
| Metallization ratio | % | 82.4 | 91.8 | 83.9 |

TABLE 2

| Item<br>Grain size | Unit | Coke breeze<br>+12 mm |
|---|---|---|
| Proximate analysis | | |
| Volatile component | mass % | 0.5 |
| Ash | mass % | 12.8 |
| Fixed carbon | mass % | 86.7 |
| Ultimate analysis | | |
| C | mass % | 85.1 |
| H | mass % | 0.1 |
| N | mass % | 1.1 |
| O | mass % | 0.4 |
| S | mass % | 0.6 |

Example 1

At first, hot metal for start-up was charged in a vertical reacting furnace, and then 50 kg of carbonaceous material were charged under stirring of the hot metal through supply of nitrogen gas, via the bottom-blowing tuyeres, at a flow rate of 15 $Nm^3$/hr. While under stirring of the hot metal through a continuous supply of nitrogen gas, there began the charging of raw materials (solid reduced iron (1), carbonaceous material and flux given in Table 1), and supply (blowing) of oxygen gas at a flow rate of 450 $Nm^3$/hr, from the top-blowing lance, to melt the solid reduced iron. Molten iron and slag were generated as a result in the furnace, and a carbonaceous material suspending slag layer and a carbonaceous material covering layer formed on the top layer portion of the slag layer. The secondary combustion ratio during melting was controlled to 20 to 30% on the basis of the above simplified calculation formula $CO_2/(CO+CO_2)$.

After one tapping's amount of molten iron and slag had stored, discharge of molten iron and slag from the tap hole began. During discharge of molten iron and slag, the charging rate of solid reduced iron was lowered to about 35% that before discharging molten iron and slag. The charge amount of flux was lowered to about 50% that before discharging molten iron and slag. The carbonaceous material, by contrast, went on being charged at the same charging rate as before discharging molten iron and slag. Also, oxygen gas and nitrogen gas went on being supplied at the same amount of supplied gas per unit time as before discharging molten iron and slag.

During discharge of molten iron and slag, the lance height was adjusted every 30 seconds in such a manner that the distance between the lower end of the top-blowing lance and the level of the melt surface was 400 to 600 mm, on the basis of the change over time of the height position (i.e., meniscus position) of the melt surface shown in FIG. 3. Accordingly, the lance height was controlled to follow the change in the height position (i.e., meniscus position) of the melt surface in the furnace in such a manner that the distance between the lower end of the top-blowing lance and the melt surface fell within a predetermined range. The feature of adjusting the lance height every 30 seconds was arrived at in consideration of the responsiveness towards changes in the combustion condition in the furnace as a result of changes in lance height.

The time taken by discharging molten iron and slag (time from tap hole opening to closing with mud) was 8 minutes. The temperature of the melt during discharge of molten iron and slag was 1504° C.

The pressure in the furnace during discharge of molten iron and slag was controlled to be about −60 Pa, gauge pressure. Therefore, no gas from inside the furnace jetted out through the tap hole, either during melting or during discharge of molten iron and slag.

Example 2

Nitrogen gas was supplied and a carbonaceous material was charged in the same way as in Example 1, using, as a hot metal, the molten iron remaining in the furnace after discharging molten iron and slag in Example 1. Next, charging of the various raw materials (solid reduced iron (3), carbonaceous material and flux given in Table 1) and blowing were started, to melt the solid reduced iron. Molten iron and slag formed as a result in the furnace, and a carbonaceous material suspending slag layer and a carbonaceous material covering layer formed on the top layer portion of the slag layer. The secondary combustion ratio during melting in Example 2 was controlled to 20 to 30% on the basis of the above simplified calculation formula $CO_2/(CO+CO_2)$.

After one tapping's amount of molten iron and slag had stored, discharge of molten iron and slag from the tap hole began. During discharge of molten iron and slag, the solid reduced iron being charged was modified to the solid reduced iron (2) given in Table 1, and the charging rate thereof was changed to about 75% that before discharging molten iron and slag, except these conditions charging of the other raw materials and blowing were continued in the same way as in Example 1.

The lance height was adjusted every 30 seconds in such a manner that the CO concentration in the exhaust gas during discharge of molten iron and slag fell within a pre-set CO concentration range, specifically 95 to 105% with respect to the CO concentration during melting. Accordingly, the lance height was controlled on the basis of the composition of the exhaust gas from the iron bath-type melting furnace during discharge of molten iron and slag. As in Example 1, the feature of adjusting the lance height every 30 seconds was arrived at in consideration of the responsiveness towards changes in the combustion condition in the furnace as a result of changes in lance height.

The time taken by discharging molten iron and slag (time from tap hole opening to closing with mud) was 8 minutes. The temperature of the melt during discharge of molten iron and slag was 1493° C.

As in Example 1, the pressure in the furnace during discharge of molten iron and slag was controlled to be about −60 Pa, gauge pressure. Therefore, no gas from inside the furnace jetted out through the tap hole, either during melting or during discharge of molten iron and slag.

Comparative Example

Except for using, as a hot metal, the molten iron remaining in the furnace after discharging molten iron and slag in Example 2, solid reduced iron was melted in the same way as in Example 1 through supply of nitrogen gas and charging of carbonaceous material, and by starting then blowing and charging of raw materials (solid reduced iron (1), carbonaceous material and flux given in Table 1). Molten iron and slag formed as a result in the furnace, and a carbonaceous material suspending slag layer and a carbonaceous material covering layer formed on the top layer portion of the slag layer. The secondary combustion ratio during melting in the comparative example was controlled to 20 to 30% on the basis of the above simplified calculation formula $CO_2/(CO+CO_2)$.

At the time that the amount of stored molten iron and stored slag reached one tapping's worth, charging of the raw material (solid reduced iron (1), carbonaceous material and flux given in Table 1) and blowing were discontinued, and then, discharging molten iron and slag was carried out. The time taken by discharging molten iron and slag (time from tap hole opening to closing with mud) was about 12 minutes, during which time the temperature of the melt dropped by about 100° C., from about 1500° C. to about 1400° C. As a result, it was necessary to raise the temperature of the melt to 1450° C. or above, to charge raw materials for the next production of molten iron.

The operation for raising the temperature of the melt involved supply of oxygen gas through the top-blowing lance for about 14 minutes. This was followed by charging of carbonaceous material alone for about 19 minutes, under continuous supply of oxygen gas. As a result, the temperature of the melt eventually recovered to about 1450° C., and there was restored a state that permitted charging of solid reduced iron and flux.

In Examples 1 and 2 and the comparative example, a comparison between an instance where charging of raw materials and blowing from before discharging molten iron and slag are also continued during discharge of molten iron and slag (Examples 1 and 2), vis-à-vis an instance where charging of raw materials and blowing are stopped before discharging molten iron and slag (Comparative example), reveals that the time required for discharging molten iron and slag could be shortened to about 8 minutes (about ⅔ of the time required in the Comparative example), that the temperature of the melt during discharge of molten iron and slag could be kept at 1480° C. or above, and that, moreover, no operation of raising the temperature of the melt was required.

As described in detail above, the present invention provides a method for producing molten iron by melting an iron source material using an iron bath-type melting furnace comprising a top-blowing lance at an upper part of the furnace, a bottom-blowing tuyere in the bottom of the furnace and a tap hole at a lower part on the side of the furnace, the method comprising: a melting process of charging the iron source material, a carbonaceous material and a flux into the furnace and top-blowing an oxygen-containing gas through the top-blowing lance while blowing an inert gas through the bottom-blowing tuyere into melt present in the furnace to stir the melt to thereby melt the iron source material and generate the molten iron and slag using combustion heat of combusting carbon in the carbonaceous material and/or in the molten iron, wherein the melting process has at least one tapping process of discharging the molten iron and the slag through the tap hole while holding a position of the furnace in generating the molten iron, and the tapping process continues or interrupts generation of the molten iron and continues top-blowing of the oxygen-containing gas to thereby keep a temperature of the molten iron in the furnace at or above a pre-set lowest temperature of the molten iron.

In the present invention, top-blowing of oxygen-containing gas is continued also in the tapping process. As a result, the temperature of the molten iron in the furnace is kept at or above a pre-set lowest temperature of the molten iron. As a result, the temperature of the molten iron in the furnace is kept high during discharge of molten iron and slag, whereby the molten iron and molten slag discharged from the furnace are prevented from solidifying. Moreover, melting of the iron source material and/or production increase of molten iron can be performed immediately after discharging molten iron and slag is just over, therefore molten iron productivity can be enhanced stably.

Preferably, the tapping process starts when the total amount of the molten iron and the slag stored in the furnace reaches a predetermined amount in the melting process. As a result, molten iron having a predetermined heat capacity at the time of discharging molten iron can be discharged through the tap hole. The tap hole can be kept sufficiently warm thereby. This allows preventing, more reliably, clogging of the tap hole during discharge of slag on account of slag solidification, and allows supplying stably a predetermined amount of molten iron to a subsequent process.

Preferably, the tapping process further continues charging of the carbonaceous material. The concentration of carbon in the molten iron as well as the amount of carbonaceous material suspended in the slag layer can be maintained through continuous charging of carbonaceous material. Thereby, the temperature of the slag layer can be prevented from dropping during discharge of slag, and clogging of the tap hole on account of slag solidification can be prevented yet more reliably. Also, the carbonaceous material suspending slag layer and the carbonaceous material covering layer can be formed easily upon melting after discharging molten iron and slag.

Preferably, the tapping process further continues charging of the flux. Slag fluidity can be secured, melting damage to the refractory can be suppressed, and slag foaming can be prevented yet more reliably, by adjusting the composition of the molten slag through continuous charging of flux.

Preferably, the tapping process further continues charging of the iron source material to thereby continue melting of the iron source material. Continuous charging of an iron source material during the tapping process allows the iron source material to melt continuously also during discharge of molten iron and slag, which allows further increasing molten iron productivity.

In the case that the tapping process continues charging of the iron source material, a charging rate of the iron source material in the tapping process is preferably smaller than a charging rate of the iron source material charged before the tapping process in the melting process. This allows preventing abrupt drops of temperature of melt during discharge of molten iron and slag.

In terms of suppressing fluctuation of the temperature of melt during discharge of molten iron and slag, it is preferable that the top-blowing lance comprises a injection port at a lower end part thereof and that a height position of the lower end of the top-blowing lance is controlled so as to follow changes in a height position of the surface of the melt in the furnace in the tapping process. More preferably, the change in height position of the surface of the melt in the iron bath-type melting furnace during the tapping process is predicted on the basis of the change over time of discharge amount of molten iron and slag during a past discharge of molten iron and slag. For instance, the height position of the lower end of the top-blowing lance is controlled on the basis of a premeasured relationship between an amount of discharged molten iron and slag and a time elapsed from a time point of starting discharge of molten iron and slag in the tapping process and on the basis of changes in the height position of the surface of the melt with time calculated from an internal shape of the furnace. It is also more preferable that the height position of the surface of the melt in the furnace is measured by a level meter in the tapping process, and the height position of the lower end of the top-blowing lance is controlled on the basis of the measured height position of the surface of the melt.

In terms of suppressing fluctuation of the temperature of melt during discharge of molten iron and slag, it is preferable that the top-blowing lance comprises a injection port at a lower end part thereof, and that a height position of the lower end of the top-blowing lance is controlled on the basis of the composition of an exhaust gas from the furnace in the tapping process More preferably, a height position of the lower end of the top-blowing lance is adjusted in such a manner that a predetermined gas concentration in the exhaust gas from the iron bath-type melting furnace falls within a predetermined range.

INDUSTRIAL APPLICABILITY

With the method for producing molten iron of the present invention, molten iron can be efficiently produced while preventing problems such as solidification of molten iron and molten slag on account of drops of temperature during discharge of molten iron and slag.

The invention claimed is:

1. A method for producing molten iron in a melting process having a tapping process, by melting an iron source material with an iron bath melting furnace comprising a top-blowing lance at an upper part of the furnace, a bottom-blowing tuyere in the bottom of the furnace and a tap hole at a lower part on a side of the furnace, the method comprising:

(A) charging the iron source material, a carbonaceous material, and a flux, into the furnace and top-blowing an oxygen-comprising gas through the top-blowing lance while blowing an inert gas through the bottom-blowing tuyere into a melt present in the furnace to stir the melt to thereby melt the iron source material and generate the molten iron and slag with combustion heat from combusting carbon in the carbonaceous material and/or in the molten iron to form a carbonaceous material suspending slag layer, in which part of the carbonaceous material is suspended, on the top layer portion of the slag, and to form a carbonaceous material coating layer, comprising only the carbonaceous material, on the carbonaceous material suspending slag layer, (B) discharging the molten iron and the slag through the tap hole while holding a position of the furnace in generating the molten iron, and (C) continuing or interrupting generation of the molten iron and continuing top-blowing of the oxygen-comprising gas to thereby keep a temperature of the molten iron in the furnace at or above a pre-set lowest temperature of the molten iron.

2. The method for producing molten iron according to claim 1, wherein the discharging (B) starts when a total amount of the molten iron and the slag stored in the furnace reaches a predetermined amount in the charging (A).

3. The method for producing molten iron according to claim 2, wherein the discharging (B) and/or continuing (C) further continues charging of the carbonaceous material.

4. The method for producing molten iron according to claim 3, wherein the discharging (B) and/or continuing (C)) further continues charging of the flux.

5. The method for producing molten iron according to claim 3, wherein the discharging (B) and/or continuing (C) further continues charging of the iron source material to thereby continue melting of the iron source material.

6. The method for producing molten iron according to claim 2, wherein the discharging (B) and/or continuing (C) further continues charging of the flux.

7. The method for producing molten iron according to claim 6, wherein the discharging (B) and/or continuing (C) further continues charging of the iron source material to thereby continue melting of the iron source material.

8. The method for producing molten iron according to claim 2, wherein the discharging (B) and/or continuing (C) further continues charging of the iron source material to thereby continue melting of the iron source material.

9. The method for producing molten iron according to claim 2, wherein the discharging (B) and/or continuing (C) further continues charging of the iron source material to thereby continue melting of the iron source material.

10. The method for producing molten iron according to claim 1, wherein the discharging (B) and/or continuing (C) further continues charging of the carbonaceous material.

11. The method for producing molten iron according to claim 10, wherein the discharging (B) and/or continuing (C) further continues charging of the flux.

12. The method for producing molten iron according to claim 10, wherein the discharging (B) and/or continuing (C) further continues charging of the iron source material to thereby continue melting of the iron source material.

13. The method for producing molten iron according to claim 1, wherein the discharging (B) and/or continuing (C) further continues charging of the flux.

14. The method for producing molten iron according to claim 13, wherein the discharging (B) and/or continuing (C) further continues charging of the iron source material to thereby continue melting of the iron source material.

15. The method for producing molten iron according to claim 1, wherein the discharging (B) and/or continuing (C) further continues charging of the iron source material to thereby continue melting of the iron source material.

16. The method for producing molten iron according to claim 15, wherein a charging rate of the iron source material in the discharging (B) and/or continuing (C) is smaller than a charging rate of the iron source material charged before the discharging (B) and/or continuing (C) in the charging (A).

17. The method for producing molten iron according to claim 1, wherein the top-blowing lance comprises an injection port at a lower end part thereof, and a height position of the lower end of the top-blowing lance is controlled so as to follow changes in a height position of a top surface of the melt in the furnace in the discharging (B) and/or continuing (C).

18. The method for producing molten iron according to claim 17, wherein the height position of the lower end of the top-blowing lance is controlled on the basis of the changes in the height position of the top surface of the melt with tapping time, which are calculated from a premeasured relationship between an internal shape of the furnace and a change in the discharged amount of molten iron and slag with time.

19. The method for producing molten iron according to claim 17, wherein the height position of the surface of the melt in the furnace is measured by a level meter in the discharging (B) and/or continuing (C), and the height position of the lower end of the top-blowing lance is controlled on the basis of the height position measured from the top surface of the melt.

20. The method for producing molten iron according to claim 1, wherein the top-blowing lance comprises a injection port at a lower end part thereof, and a height position of the lower end of the top-blowing lance is controlled on the basis of a composition of an exhaust gas from the furnace in the discharging (B) and/or continuing (C).

21. A method for producing molten iron in a melting process having a tapping process, comprising melting an iron source material with an iron bath melting furnace comprising a top-blowing lance at an upper part of the furnace, a bottom blowing tuyere in the bottom of the furnace and a tap hole at a lower part on a side of the furnace, the method comprising:

(A) charging the iron source material, a carbonaceous material, and a flux, into the furnace and top-blowing an oxygen-comprising gas through the top-blowing lance while blowing an inert gas through the bottom-blowing tuyere into a melt present in the furnace to stir the melt to thereby melt the iron source material and generate the molten iron and slag with combustion heat from combusting carbon in the carbonaceous material and/or in the molten iron, (B) discharging the molten iron and the slag through the tap hole while holding a position of the furnace in generating the molten iron, and (C) continuing or interrupting generation of the molten iron and continuing top-blowing of the oxygen-comprising gas to thereby keep a temperature of the molten iron in the furnace at or above a pre-set lowest temperature of the molten iron, wherein the top-blowing lance comprises an injection port at a lower end part thereof, and a height position of the lower end of the top-blowing lance is controlled so as to follow changes in a height position of a top surface of the melt with tapping time, which are calculated from a premeasured relationship between an internal shape of the furnace and a change in the discharged amount of molten iron and slag with time.

* * * * *